US005175403A

United States Patent [19]

Hamm et al.

[11] Patent Number: 5,175,403

[45] Date of Patent: Dec. 29, 1992

[54] RECLOSER MEANS FOR RECLOSING INTERRUPTED HIGH VOLTAGE ELECTRIC CIRCUIT MEANS

[75] Inventors: Sidney R. Hamm, Muskego; Ronald A. Wainio, Milwaukee, both of Wis.

[73] Assignee: Cooper Power Systems, Inc., Houston, Tex.

[21] Appl. No.: 748,653

[22] Filed: Aug. 22, 1991

[51] Int. Cl.[5] ..... H01H 33/66; H01H 33/14

[52] U.S. Cl. ..... 200/144 B; 200/145; 335/240

[58] Field of Search ..... 200/144 B, 145; 335/239, 240

[56] References Cited

U.S. PATENT DOCUMENTS 3,594,525 7/1971 Miller et al. ..... 200/145
3,727,019 4/1973 Harvey ..... 200/144 B
4,506,244 3/1985 Jabagchourian et al. ..... 200/144 B

*Primary Examiner*—Harold Broome

*Attorney, Agent, or Firm*—Laff, Whitesel, Conte & Saret

[57] ABSTRACT

An interrupted electric circuit recloser for reclosing an interrupted high voltage electric circuit system and a solenoid to be utilized for use in a sealed pressurized dielectric gaseous atmosphere. The recloser has a sealed tank and a solenoid therein. The solenoid has a plunger connected through a yoke for returning vacuum contact back to a closed contacting position, a dampener for regulating the opening movement of the plunger, a dielectric gas filling the sealed chamber and permeating the solenoid and acted on by the solenoid plunger. The solenoid also has a central chamber complimentarily accepting the plunger. The central chamber of the solenoid is substantially closed at one end and permits the ingress of the dielectric gas when the plunger is moved in an outward direction within the central chamber away from the closed end and a second dampener controlling the solenoid plunger's movement toward the closed end.

25 Claims, 7 Drawing Sheets

RECLOSER MEANS FOR RECLOSING INTERRUPTED HIGH VOLTAGE ELECTRIC CIRCUIT MEANS

This invention relates to an improved gas insulated recloser means for reclosing a high voltage circuit means, generally three phase in nature, by sensing overcurrents and automatically interrupting and reclosing to clear faults and to restore service if a fault is temporary. A spring is utilized for the opening of the circuit means and a system high voltage operated solenoid with pneumatic damper closes the circuit means and charges the spring. A pneumatic damper means is provided to reduce the opening contact bounce when opening.

BACKGROUND OF THE INVENTION

The prior art reclosers included oil filled tanks having the operating mechanisms immersed in oil and were generally self-contained, taking operating energy directly from the system. They included controls that signaled a low-energy solenoid to initiate tripping operation. Reclosing and trip-spring energy was provided by a closing solenoid. There was dual timing of both phase-trip and ground-trip operations provided by proper setting of timing-sequence selectors. Each of these recloser operations was controlled by mechanical means, except for the over-current sensing and trip timing which was controlled by an electronic control.

Arc interruption took place within three sealed, vacuum interrupters. Oil was used in such reclosers for electrical insulation, but was not involved in arc interruption. The oil was also used in the counting mechanism which determined how many times the recloser should cycle before permanent shutdown.

The moving contacts in the vacuum interrupters were pulled open by release of the opening spring. The low-energy tripper, which is operated by the electronic control system, releases the opening spring when current above the minimum trip level, or a ground (earth) fault, is sensed.

The ground (earth) fault tripping feature sensed zero sequence current with sensing current transformers, located inside the recloser. When the zero sequence current exceeds the selected minimum ground-trip level and remains above that level through the selected timing period, the control operates the low-energy tripper to release the contact opening spring.

Closing energy, as well as energy to charge the opening spring, is supplied by a closing solenoid momentarily connected phase-to-phase through a contactor.

In these previous devices the oil filled tank, that was provided as an insulating medium, was sensitive to fire and explosions.

SUMMARY OF INVENTION

This invention relates to a three-phase, gas ($SF_6$) insulated, vacuum fault interrupting device suitable for either substation or pole mounting.

Such a recloser is a self-contained tank device that protects distribution line and equipment. The recloser trips open on overcurrent (either phase or ground faults) and then recloses automatically. If the overcurrent is temporary the automatic reclose restores normal service. If the fault is permanent a preset number of trip and reclose operations, preferably, four shot close-open operations, are performed to lockout. All three phases of the recloser open, reclose and lockout simultaneously.

Arc interruption takes place within three sealed vacuum interrupters. $SF_6$ gas is used within the tank chamber as an insulating medium but is not involved in the vacuum arc interruption. The moveable contacts of the vacuum interrupters are driven apart by the release of opening springs that are preloaded when the recloser is closed. The energy to operate the recloser mechanism by closing the vacuum interrupter contacts, compress the contact pressure springs, as well as energy to charge the opening springs, is supplied by a high-voltage closing solenoid momentarily connected phase-to-phase through a high-voltage contactor. The closing solenoid obtains its power from the high voltage system (e.g. 14.4 kV) or a low voltage supply (e.g. 240 VDC). The contactor is mechanically closed by a low voltage rotary solenoid actuated by a signal from an electronic control. The closing solenoid operates through a ten percent, plus or minus, system voltage range to provide adequate force for fast operating times (e.g. −4 shot close-open operations).

It is a compact design and allows for various coils to be utilized at different system voltages (e.g. 14.4, 13.2, 12 & 6 kV).

Dampener means are provided for the solenoid plunger in the opening and closing operations, which dampener means limit the plunger opening time to set control switches, while the dampener means on closing limits the plungers speed and impact. Additionally, the choice of various magnetic plunger materials permits the regulation of magnetic permeability and force of operation. In the present invention the dampener means consists of pneumatic dampener means to reduce the opening contact bounce of the vacuum interrupting devices, preferably there are two pneumatic means, one for the opening and one for the closing, that are compact and effective for their intended purpose.

Referring now to the drawings wherein similar parts are designated by similar numerals.

BRIEF DESCRIPTION OF THE DRAWINGS

FIGS. 6, 6A and 6B, respectively show, a vertical elevational view in partial section of a piston utilized in the closing solenoid, as shown in FIG. 5, while FIG. 6A is a bottom view of said piston showing its radial relief slots, and FIG. 6B is a top view thereof showing its transverse radially disposed relief slot;

DETAILED DESCRIPTION

Figure 1:
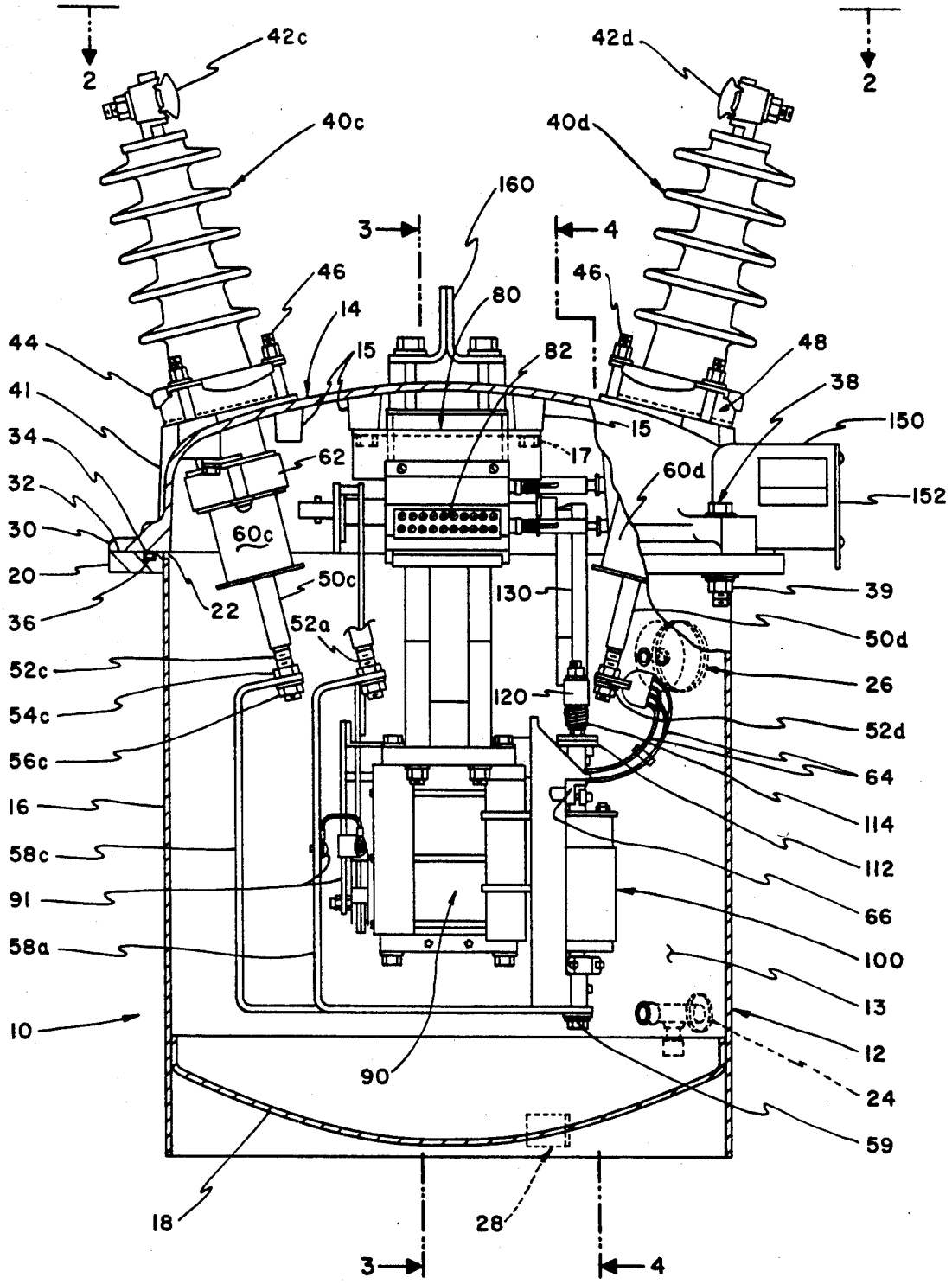
FIG. 1 is a Vertical elevation in partial section of the principal embodiment of the present invention, taken along line 1—1 in FIG. 2.

Referring now to FIG. 1, the recloser 10 of the present embodiment includes a tank assembly 12 and a cover assembly 14. The tank assembly 12 generally has a cylindrical metallic wall 16 with inwardly concave pressurizeable bottom end wall 18 and an outwardly extending flange means 20 at the opposite open end 22. The side wall 16 carries a valve means 24 for providing ingress and egress from the interior of the tank 12, and a pressure guage means 26 also communicating with the interior of the tank 12. A parallel ground connector 28 is also provided.

The cover assembly 14 also has a complimentary laterally extending flange 30 adapted to be juxtaposed flange 20 and when properly seated thereon will compress a gasket means 32 as well as an O-ring 34 seated in a circumferentially disposed groove 36 in flange 20 to provide a sealed chamber 13. A plurality of fastening means such as bolts 38 are circumferentially spaced around the perimeter of cover 14 and are designed to mate with means such as nuts 39 associated with flange 20 to clamp the two flanges 20 and 30 together in sealed relation. Chamber 13 is designed to provide a dielectric chamber by being pressurized with the insulating gas Sulphur Hexafluoride ($SF_6$) to 15 PSIG.

The cover assembly 14 is preferably a rigid cast metallic member having a plurality of circumferentially spaced externally projecting apertured boss means 41 adapted to provide seat means for mounting a like number of insulated bushing assemblies 40 that project upwardly and outwardly in angular relationship to the axis of the tank and cover assemblies. At the outer extremity of each bushing assembly there is a terminal member 42. (It will be noted in FIG. 2 that there are six bushing assemblies 40 with each bushing assembly being designated by the numeral 40 with the addition of a suffix letter designator of a-f. When reference is made to a particular bushing assembly as well as any other member being associated with that particular assembly its identifying numeral will also carry the same suffix letter for purposes of identification and reduction of alphanumeric identifiers. The bushing has been patented under U.S. Pat. No. 4,965,407).

The bushing assemblies 40 are each retained in sealed relation to the bored seat 41 by means of clamp means 44 and threaded stud means 46 which clamp the O-ring 48 recessed in the base of each insulated bushing against the seat 41.

Extending co-axially inwardly from each insulated bushing is a cylindrically shaped bell-mouthed shield 60 that encircles the co-axial lead 50 extending from the connector 42 to its opposite threaded free end 52. As shown in FIG. 1, lead 50*c* and its threaded end 52*c* accept a stop-nut 54*c* and a locknut 56*c* for engaging and supporting one end of the bus 58*c* which is a substantially rigid metallic member that connects at its opposite end 59*c* with the appropriate fixed contact of a vacuum interrupter 100*c*.

Also associated with each shield 60 is a bushing current sensing transformer 62. These inductive coils provide both phase- and ground-(zero-sequence) current sensing and are connected to the electronic control cabinet 80.

Figure 2:
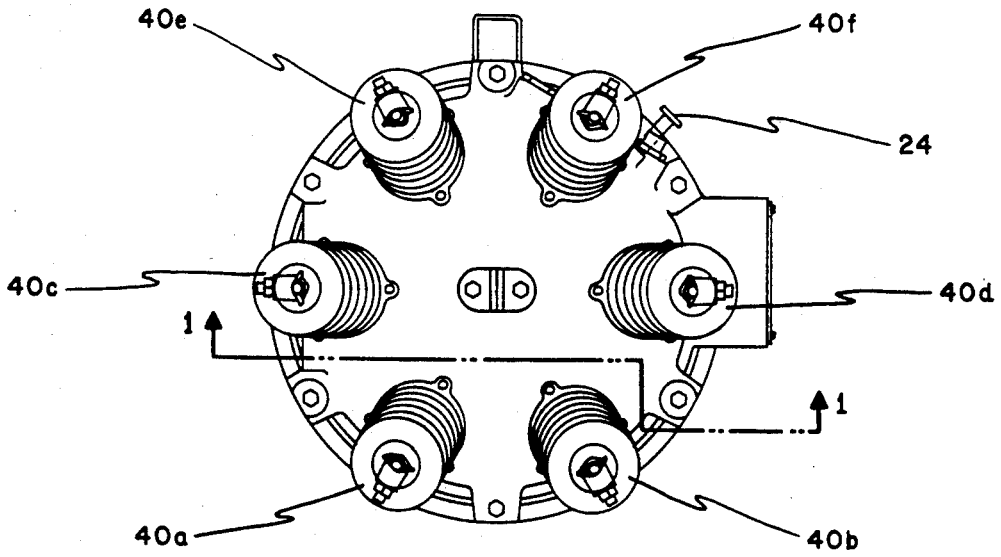
FIG. 2 is a top plan view taken along line 2—2 in FIG. 1.

As seen in FIG. 2, the three source bushings 40*a*, 40*c*, and 40*e* are aligned with the three load bushings 40*b*, 40*d*, and 40*f*, respectively, for identification and orientation of the phases of the current carried by the three conductor. Thus, the vacuum interrupter 100*c*, identified above, includes a fixed or non-moveable contact 102 to which bus 58*c* is connected, while its moveable contact 103 (as seen in FIG. 7) is connected at its upper or moveable end by means of a flexible braided cable 64 that extends from the current exchange 66 to the lead 52*d* of bushing 40*d*, as seen in FIG. 1.

The cover assembly 14, as was indicated above, includes a plurality of bosses 15 having threaded bores adapted to accept threaded fastener means such as studs 46 and screws 17 for fastening and supporting the mechanical and electronic control assembly 80, the internal wiring terminal 82, appropriate supporting framework for the high voltage closing solenoid assembly 90, the vacuum interrupters 100, and the externally mounted sleet hood 150 that includes an access cover 152 for exposing a manual operating handle 154, and a counter lever 156. Handle 154 and its connecting rod 154*a* can be used manually to initiate opening of an energized recloser. If the handle is left down it also serves to lockout the recloser. It can be manually returned.

Thus, after release of the pressurized SF6 gas through the valve 24, the cover assembly 14 along with all of the operating mechanisms attached can be removed from the tank 12 by gripping the lifting strap 160 thereby providing easy access to the mechanisms for checking or repair.

Figure 4:
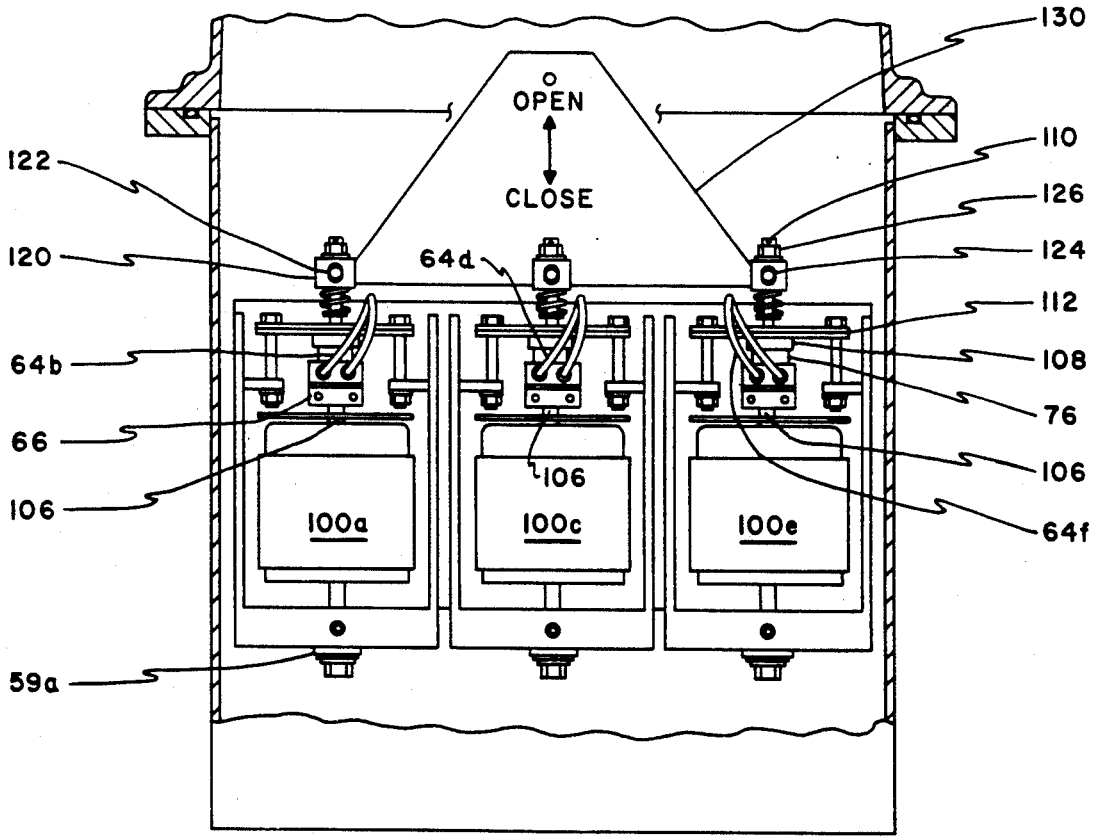
FIG. 4 is a schematic vertical view in section taken generally along line 4—4 in FIG. 1 showing the disposition of the vacuum contact means as interconnected with the actuating yoke and also showing the relative positions of the opening pneumatic dampener means.
Figure 3:
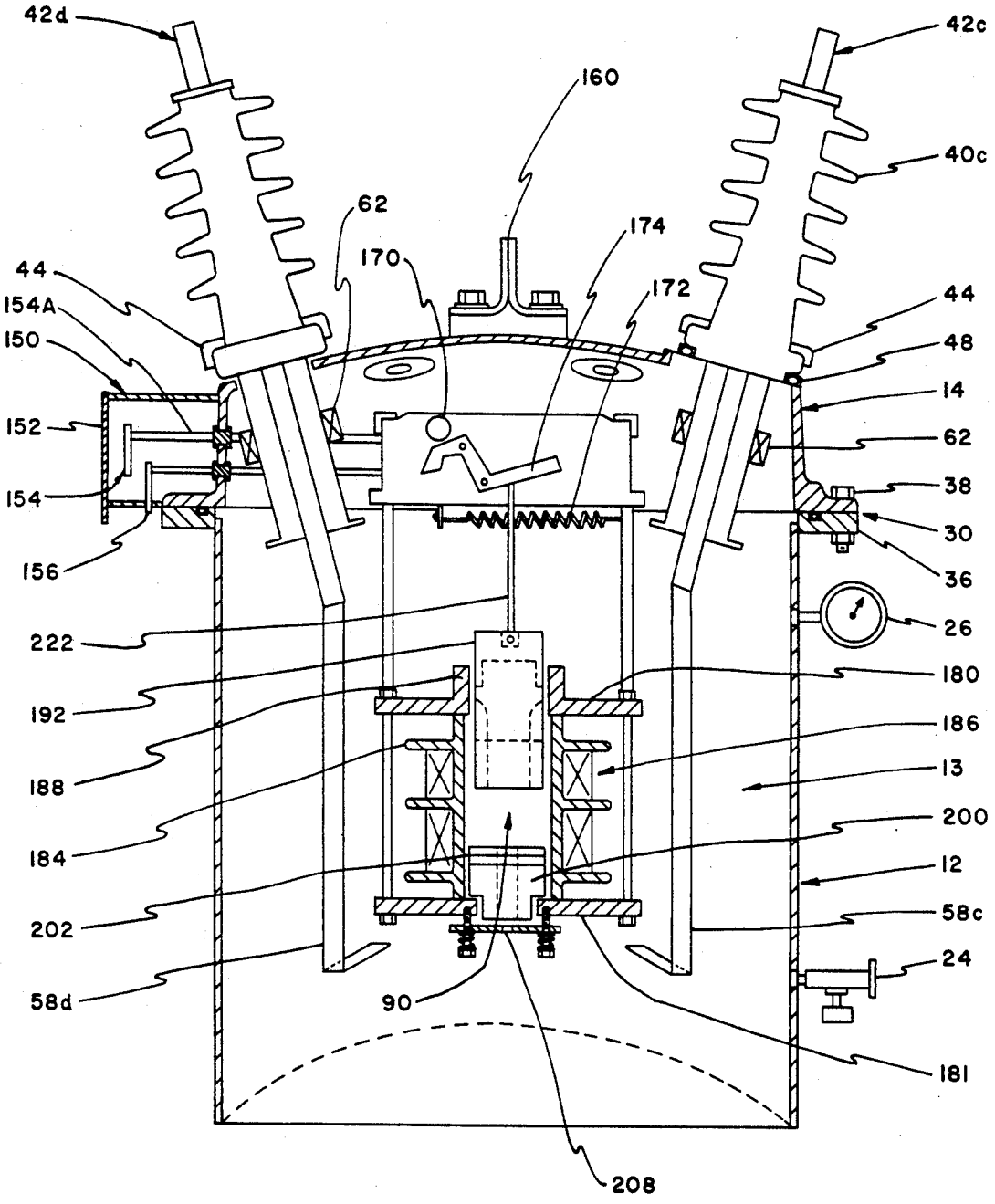
FIG. 3 is a schematic vertical view in section taken generally along line 3—3 in FIG. 1, with the cover rotated ninety degrees from the position in FIG. 1 to schematically display the manual externally available mechanical control rods.
Figure 7:
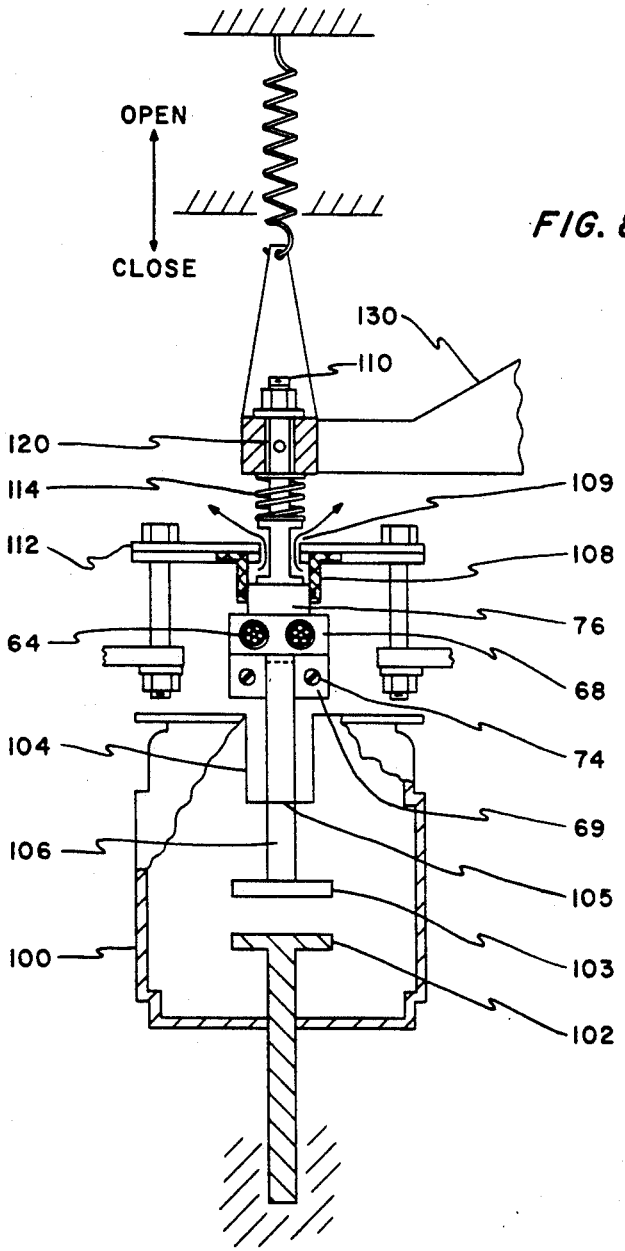
FIG. 7 is an enlarged generally schematic elevational sectioned view of a vacuum interrupter device, its current connector, piston and chamber means for the opening dampening means, and schematic representation of the opening spring, connecting yoke and closing contact pressure spring.
Figure 8:
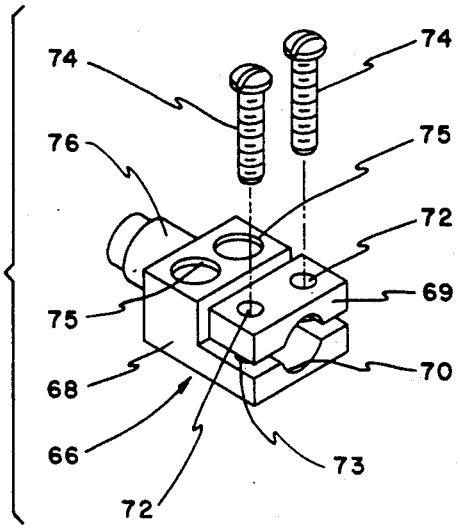
FIG. 8 is an exploded view of a current connector means utilized in the present invention.

Referring now to FIG. 7, along with FIGS. 1 and 4, the schematic view in FIG. 7 shows the vacuum interrupter 100 with its fixed contact 102 and spaced therefrom the moveable contact 103. The interrupter includes a flexible means 104, i.e. such as a diaphram or bellows, sealing fastened, as at 105, to the rod-like actuator 106 attached to moveable contact 103.

The current exchange 66 is a substantially rigid metallic member having a stepped base portion 68 and a transversely disposed clamping member 69, with base portion 68 and member 69 having facing axially disposed groove means 70 generally complimentary to the configuration of actuating rod 106. A pair of preferably pilot holes 72 pierce the clamping member 69 on opposite sides of groove means 70 and communicate with threaded bores 73 aligned with the pilot holes 72 that are adapted to accept screw means 74 for providing adjustable clamping of the rod 106 or other suitable means. The raised portion of the stepped base portion 68 includes at least one bore 75 adapted to accept the braided cable conductor 64 for transmitting current from the interrupter to the lead 50 of its companion phase bushing for transmittal thereof to the load. In the present preferred embodiment there are two such bores 75.

An integral piston 76 extends axially outwardly from the end of base portion 68 opposite to the grooved clamping end. When current exchange clamp 66 is assembled with rod 106, as best seen in FIG. 7, it is co-axially disposed within a floating inverted cup-like cylinder means 108 that is secured by a lateral flange at its apertured closed end within the framework 112. The aperture 109 is adequate to permit sliding motion for the rod 110 that has an enlarged end engaging the free end of piston 76. A constant pressure spring 114 encircles rod 110 and acts against the structure adjacent the closed end aperture 109 to provide a reactive force on spring 114 when it is moved by the active force provided by yoke 130.

The yoke 130 carries a plurality of parallel axis bearing means 120 adapted to accept rods 110. The sidewall of bearing means 120 has an axially disposed slot 122 that is adapted to accept transverse pin means 124 that is mounted on rod 110 so as to provide means for preventing rotation of rod 110 as well as providing means for limiting the axial movement of the rod 110 within predetermined parameters. Movement of the yoke 130 and its integral bearing means 120 results in accurate movement of the moveable contact 103 and an insured predetermined contact pressure, between contacts 102 and 103, through the action of spring 114. The outward movement of rod 110 and its assembly with bearing means 120 is controlled by locknut 126 on a threaded free end of rod 110.

The presence of the pressurized gas SF within the dielectric chamber 13 will permeate the interior of cup-like cylinder 108 so that upward movement of piston 76, as viewed in FIG. 7, will result in the increase pressure of the gas within cup-like cylinder 108 with its slow release through the differential in size of rod 110 and aperture 109. This forms an opening dampener that will substantially reduce rebound bounce of the contact means 103 when opened by movement of yoke 130. Thus, the contact gap between contacts 102-103 is maintained through use of this dampener. The dampener acts as an absorber of energy during contact opening. After the contact rebound, a vacuum is set up in the absorber chamber to hold to contact rebound until the contacts come to rest.

The new improved high powered closing solenoid assembly, generally designated 90, is best described by reference to FIGS. 3, 5, 5A and 6-6D. Seen schematically in FIG. 3, the mechanical and electrical control assembly 80 includes means for activating a low energy tripper 170 (shown schematically since it is on the opposite side of the mechanism) that will move a lever 174 (not shown schematically) to release the opening spring 172 that in turn will cause the opening of the solenoid 90 and the upward movement of yoke 130 with the resultant opening of the vacuum interrupter contacts 102-103. All of the above will be reset by activation of the closing solenoid assembly 90.

Figure 6B:
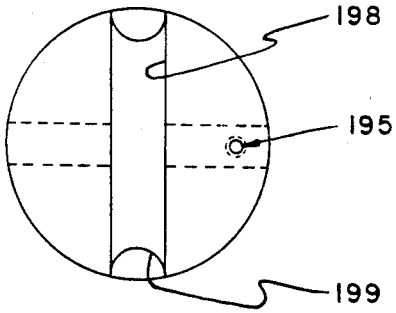
Figure 6D:
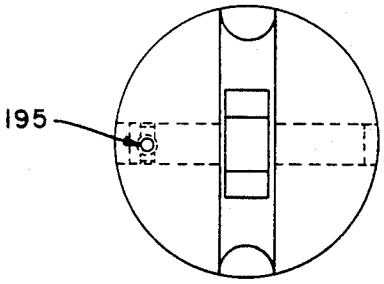
FIGS. 6C and 6D show a partial elevation view with a crank and its connecting pin assembled with a piston of the type shown in FIGS. 6-6B along with an end top view of the assembly.
Figure 6:
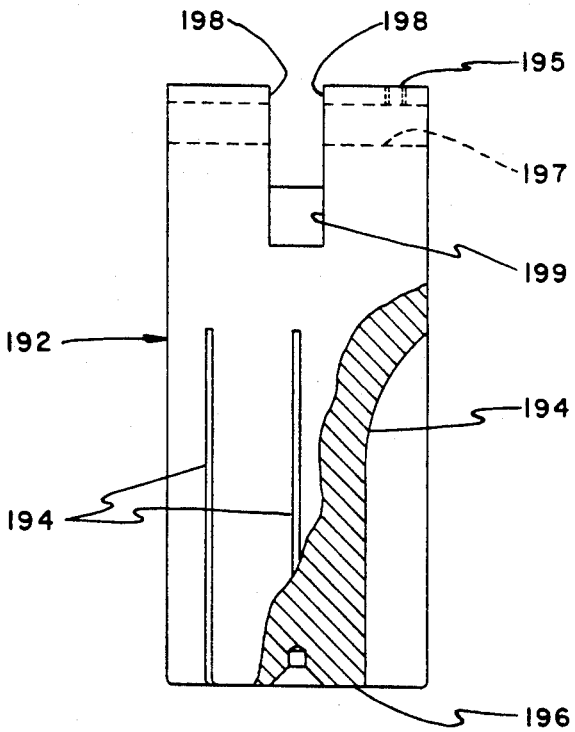
Figure 6A:
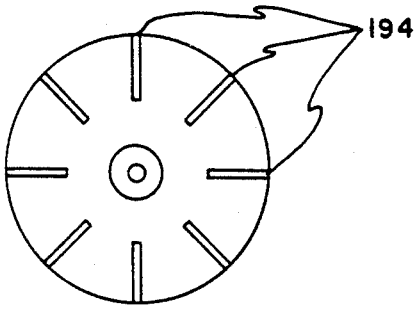
Figure 6C:
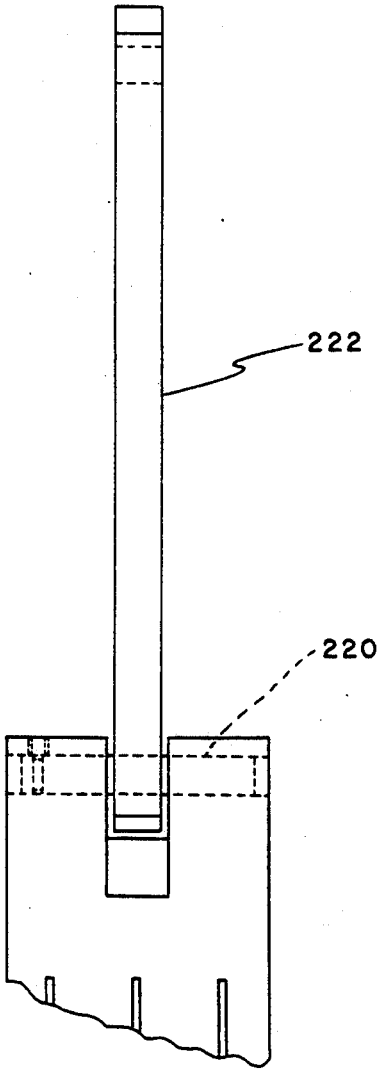

A rigid solenoid frame 180 and bridge plate 181, maintained in spaced relation by spacers 182, carry the coil form 184 and its associated pot coil 186. The upper frame 180 includes a central cylindrical flange 188 that defines a centrally disposed cylinder 190 adapted to complimentarily accept the plunger 192, a slight spacing existing between the plunger 192 and the cylinder wall 190. The plunger 192, which can be best seen in FIGS. 6-6D, is a metallic cylinder formed from magnetic material, i.e. chosen from the class including materials such as malleable iron, stainless steel, ductile iron, etc.. The pot coil is wound on the coil form with the leads connected to the high voltage system through a switch and appropriate leads, such as designated at 91 in FIG. 1. The solenoid frame 180, bridge plate 181 and spacers 182 are all part of the magnetic circuit. A plunger stop assembly 200 is provided at the bottom within the coil form 184 and bearing on bridge plate 181, it consists of an absorbent stop 202, an aluminum ring spacer 204 and the plunger stop 206 that stops the plunger impact during a closing operation, and, except for the aluminum ring 204, are part of the magnetic circuit. A central through bore 207 traverses each of the elements of the, plunger stop assembly and is aligned with a spring loaded orifice plate 208. As the plunger 192 is driven downward, as viewed in the drawing, it compresses the gas in chamber 185, since the gas flow is restricted by the spacing between the plunger 192 and the cylinder wall 190 and the orifice plate 208. This results in a damper action. A build-up in pressure is released by axial movement of orifice plate 208 along guide pins 210 against springs 212. Slots 199, as best seen in FIG. 6, provide a fast gas release when the plunger is at the bottom end of its stroke. Similarly, when the plunger 192 moves upwardly to the open position there is a tendency to create a negative pressure situation, not unlike a vacuum, until the slots clear the edge of the neck or flange portion 188 when additional gas can then flow into the chamber 185.

Figure 5:
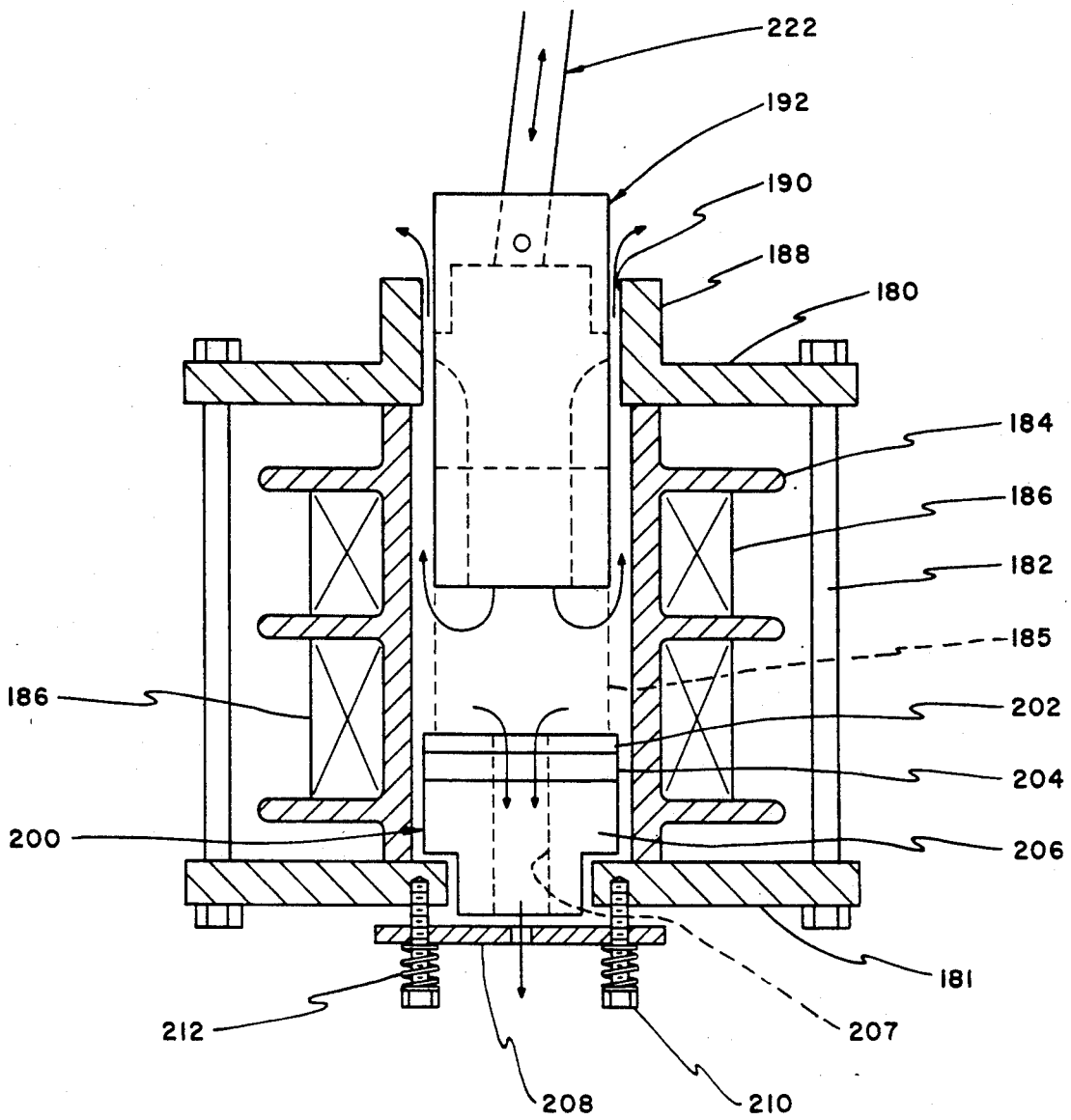
FIG. 5 is enlarged schematic elevational view in partial section of the closing solenoid with one embodiment of an integral dampening means for the closing function, as well as showing the gas flow around the piston utilized in the closing solenoid.
Figure 5A:
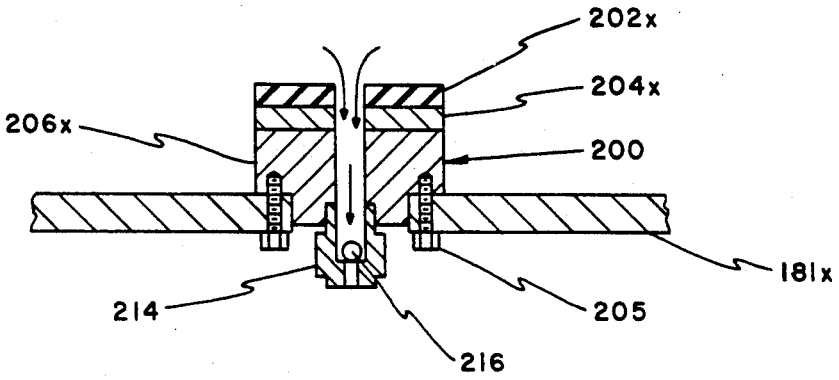
FIG. 5A is another embodiment shown in a partial elevational view in section of a relief valve utilized in the closing dampener means.

Another embodiment is shown in FIG. 5A, wherein similar parts are identified by similar numerals with the addition of the letter x as a suffix. the plunger stop 200 includes a shock absorbent member **202*x*, an aluminum stop ring 204*x* and a plunger stop means 204*x* having fastening means 205 for securing stop means 204*x* fixedly to the bridge plate 181*x*. In this embodiment, rather than a spring loaded orifice plate 208, there is provided a relief valve means 214 having a restricted bore. Such a restricted bore may, if desired, be blocked by a ball cock 216 that is seated in the restricted bore until a partial vacuum is created by the plunger 192** during its opening stroke, when the ball moves upwardly to admit gas into the chamber.

The metallic magnetic plunger 192 provides a plurality of circumferentially spaced axially extending slot means 194 opening through the bottom end 196. At the opposite or upper end the plunger 192 has a diametral wide slot 198 with axial extensions 199 at the ends of the slot 198. A transverse pin bore 197 traverses the slot 198 in perpendicular fashion and is adapted to accept a circumferentially grooved pin 220 (shown in phantom) that is engaged by set screw 195 to prevent axial movement f pin 220. A drive link 222, apertured adjacent one end, is retained by pin 220 in limited movement relative to plunger 192 and is connected by suitable lateral means to the yoke 130 for inducing movement in the vacuum interrupter means 100.

As the plunger 192 moves from a closed to an open position $SF_6$ gas will enter the inner chamber 185 within the coil form 184 through the relief valve means 214 having the restricted bore. Slots 194 provide a fast gas release when the plunger is at the upper end of its stroke.

Figure 9:
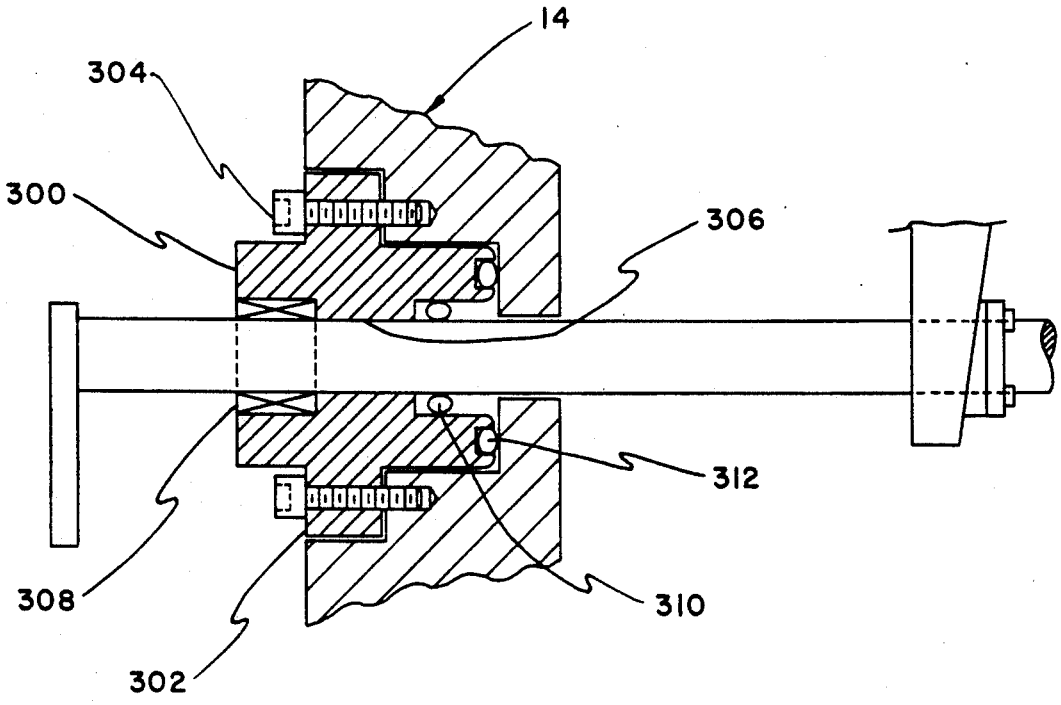
FIG. 9 is a first embodiment of a suitable sealing means for use with the externally extending mechanical operating rods of the present invention.

As was previously indicated the cover assembly 14 includes a laterally extending overhanging member designated as a sleet hood 150 having a closing access panel or plate 152 that provides access to a manual operating handle 154 and a counter lever 156. These levers are connected to control rod means that must communicate with the interior of the sealed chamber 13 formed by the tank and cover assemblies and, hence, must be provided with suitable seal means to prevent leakage of the SF gas that is at 15 PSIG. A first module embodiment is shown in FIG. 9 is applicable to either control rod 154, or 156. Cover 14 is counterbored to two differing diameters to accept seal housing 300. Seal housing 300 includes a laterally extending apertured flange means 302 adapted to accept screw means 304 for retention in cover. Seal housing 300 is generally cylindrical, except for the flange means 302, and has a reduced diameter 306 intermediate the ends of the bore and with an increased diameter adjacent its mouth for acceptance of rotary bearing means 308 for accurate support of the control rod. The opposite end of the bore is also enlarged to accept rotary seal means 310 for sealing engagement with the rod. The face of the end of seal housing 300 introduce into the counterbore in the cover 14 is provided with an annular groove sized to accept an O-ring 312 which will be compressed into sealing relation with cover 14.

Figure 9A:
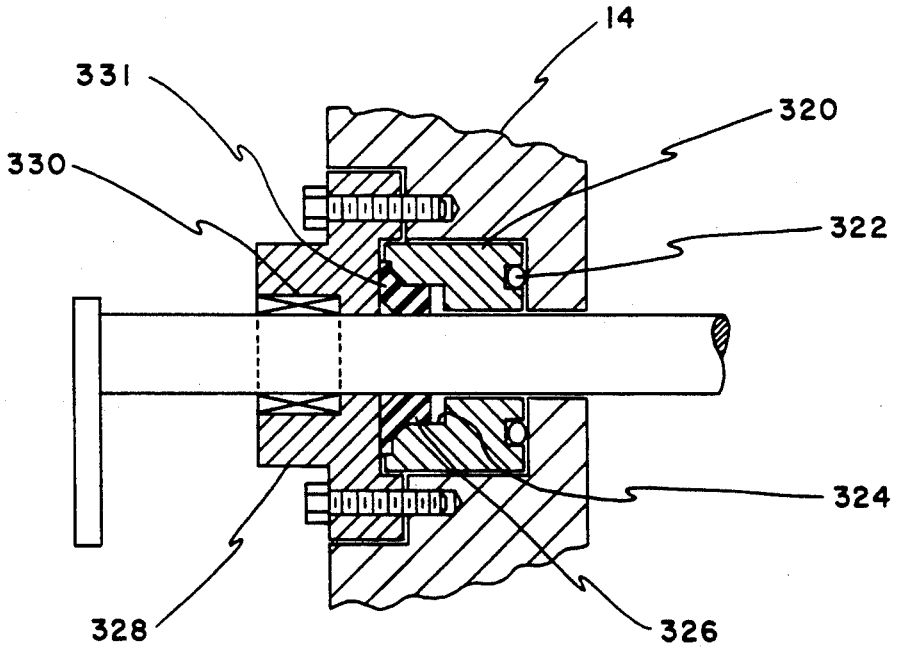
FIG. 9A is a second embodiment of a suitable sealing means for use with the externally extending mechanical operating rods of the present invention.

A second embodiment of a control rod sealing means is seen in FIG. 9A. While the first rod sealing embodiment was a single piece of metal, he present embodiment is a two piece metallic device. An inner sealing member 320 includes a groove in its entering face to accept an O-ring seal means 322 and a co-axial counterbore 324 at the opposite end adapted to accept a flanged radial sealing means 326 which, upon compression, will readily accept the control rod in rotatable sealing relation. The second metallic outer bearing member 328 is counterbored at its outer end to accept rotary bearing means 330. This outer member is clamped by adjustable fastening means, in this example screw means, to compress the flange of radial sealing means 326 into intimate sealing relation to the control rod. The alignment between the outer bearing member 328 and inner sealing member 320 is held by counter bore 331 fit.

The present embodiment utilizing $SF_6$ gas as the dielectric agent, within the tank and permeating all members other than the vacuum interrupters will normally operate in a predetermined manner, with the closing solenoid assembly 90 providing the closing energy and force necessary to provide the closing function to the recloser as has been previously mentioned. The plunger is required to return to the open position in a required time limit so that it can repeat the close-open sequence. To clarify the operation the sequence of operation is described below in a step process:

1. The plunger starts in the open position by the mechanism forcing and holding the drive linkage and therefore the plunger.
2. A voltage is applied to the pot coil producing a magnetic field that applies a downward force to the plunger to move it to the closed position. Opposing forces are produced in the pot coil and its holding frame parts (e.g. —solenoid frame, bridge plate, plunger stop assembly, orifice plate, and spacers)
3. As the plunger starts downwardly towards its close position the radial slots are sealed at the upward end by the solenoid frame and the pressure in the SF6 gas filled chamber starts to rise. The increase in pressure will dampen the forces on the plunger and to slow it down to lessen impact and to increase the operating voltage range to obtain plus or minus 10% voltage range of the nominal operating voltage rating (e.g. −14.4 kV).
4. The magnetic field pulls the plunger downward until the plunger hits the plunger stop.
5. The force magnitude is determined by the voltage and its waveshape, the magnetic circuit path (e.g. —plunger, plunger stop, bridge plate, spacers, solenoid plate or coil form, and pot coil dimensions), and the location of the radial slots in the plunger and the aluminum plunger stop ring. The thickness of the aluminum plunger stop ring changes the magnitude of the final downward force in the closed position. It has a slight reduction in the open position. The length of the radial slots effects the force on the plunger. The longer the slots then the higher the force. Regulating the length of the slots then helps to control the operating voltage range available.

Also, the depth of the radial plunger slots effects the eddy losses and magnetic field produced in the plunger. The deeper the slot the less the eddy current losses are and the more efficient the plunger force is.

6. At the end of the plunger downward stroke the pressure in the $SF_6$ gas chamber must be relieved to limit the speed at which the plunger returns to the open position. To reduce the pressure, gas release slots have been put into each side of the plunger at the ends of the wide diametral slot. When the slot passes the edge of the solenoid frame the pressure is relieved.
7. As the mechanism is tripped and the drive link pulls the plunger to the open position, the plunger must return within a required time to the open position for recycling. To assure this, an orifice or check valve is located on the plunger stop and connected to the SF6 gas chamber. At some point in the open stroke the pressure in the chamber is dissipated and a vacuum-like negative pressure is developed. This applies a retarding force on the plunger to slow it.
8. Tests have been run on a SF6 gas recloser in four (4) shot sequences (the contacts close and open four (4) times at variable times. The trip time and recloser times can be changed in the control assembly). As was noticed and recorded the plunger closes in approximately 0.020 seconds and has a trip time of 0.05 seconds to dissipate the plunger pressure build up. The plunger travel shows when there is a pressure in the $SF_6$ gas chamber and when there is a vacuum.
9. The magnetic path is designed so that the ampere-turns produced provides a flux to obtain a reactance to give a certain range of amps. This is a non-linear process and requires an extreme amount of calculation and testing, since there is no exact method for calculation. At lower ranges of voltages the flux densities produced are below the knee of the magnetization curve for the solenoid design. At the higher voltage ranges the flux is approaching and above the knee of the magnetization curve and the magnetic circuit goes into saturation. Much of the saturation occurs in the plunger and therefore the coil reactance is maintained but the flux density remains constant, and therefore the force, results in a stable plunger force at higher voltage.

Thus, a new improved recloser has been disclosed that provides dampener means acting during both the opening as well as the closing operation. An improved solenoid plunger is provided having means for controlling the effect of the compression of the gas means during closing and a vacuum effect during opening. Slot means in the plunger are provided for control of the SF6 gas as well as providing means for reducing the eddy current losses to provide a more efficient solenoid.

Other configurations will be apparent to those skilled in the art and it is our intention to be limited only to the appended claims and their equivalents where available.

We claim:

1. An interrupted electric circuit recloser means for reclosing an interrupted high voltage electric circuit system, said recloser means including means for opening multiple vacuum contact means which will be tripped and separated by the absence/excess or severe reduction in normal high voltage, an enclosure means having a sealed tank and cover for encasing the parts of said recloser means in a sealed chamber, a solenoid means in said sealed tank and including a solenoid plunger means connected through a yoke means for returning said vacuum contact means back to a closed contacting position, dampening means for regulating the opening movement of said solenoid plunger, a dielectric gas filling said sealing chamber and permeating said solenoid and acted on by said solenoid plunger, said solenoid including a central chamber complimentarily accepting said solenoid plunger and with said central chamber of said solenoid being substantially closed at one end, said central chamber including means in said closed end to permit the ingress of said dielectric gas when said solenoid plunger is moved in an outward direction within the central chamber away from said closed end and a second dampener means controlling said solenoid plunger's movement toward said closed end.

2. A recloser as claimed in claim 1 wherein said solenoid is axially disposed in a vertical position with said closed end being disposed at the bottom of said solenoid chamber and with the upper opposite other end of said chamber being substantially open, said plunger including link means extending upwardly out said open other end of said solenoid chamber and said yoke means connecting said link means to said contact means, recloser opening spring means, plunger latch means releasing said opening spring means and permitting it to draw said plunger upwardly whereby said plunger will extend partially out of said solenoid chamber, said link means and said yoke means connected to and causing said vacuum contact means to open, said dielectric gas means flowing into said solenoid chamber vacated by said plunger upward movement, and controlled orifice means in said closed end to permit the ingress of said dielectric gas means into said chamber, said orifice means also assist in the controlling the egress of said dielectric gas means when said plunger compresses same during its downward stroke, said downward stroke causing said link and yoke means to close said vacuum contact means.

3. A recloser as claimed in claim 2 wherein said link means includes an actuator adapted to close said vacuum contact means on said downward stroke of said link means and includes a second damper means acting on said actuator during said opening operation to limit opening rebound of said contacts.

4. A recloser as claimed in claim 3 wherein said actuator is a coaxial assembly including said vacuum contact means having a pair of isolated co-axially disposed contact means within an evacuated chamber including a fixed lower contact that has externally extending current carrying means, a moveable upper contact that also has integral externally extending rod-like moveable current carrying means, current exchange means having clamping means for generally co-axially gripping said rod-like means and connector means for accepting conductor means, said current exchange means also having piston-like means projecting co-axially from its end opposite said gripping means, inverted cup-like cylinder means having an open lower end and an apertured upper closed end adapted for complimentary sliding acceptance of said piston-like means within said lower open end, spring-loaded rod means telescopically accepted within said apertured closed end and providing means for bearing on the free end of said piston-like means, yoke means interconnected with said link means adapted to transmit active movement of said solenoid means to said moveable contact means in said vacuum evacuated chamber through said spring-loaded rod means and said current exchange means.

5. A recloser as claimed in claim 3 wherein when said plunger reaches the top of its opening stroke it contacts a closing circuit energizing the closing coil of said solenoid thereby drawing said plunger and said link back down to repeat the contact closing operation, means for controlling the dampening of the downward movement of said plunger and regulating its velocity.

6. A recloser as claimed in claim 5 wherein movement of said plunger downwardly in the process of closing said contacts reactivates the stored power of said opening spring means for immediate availability if another or a continuing interruption takes place.

7. A recloser as claimed in claim 6 wherein said recloser includes counting means whereby said recloser will carry out a full cycle of attempting to maintain the contacts in a reclosed condition a predetermined number of times, upon reaching said predetermined number of times if the attempt to maintain the contacts in a reclosed condition is not possible then the counting means causes the recloser to cease any further automatic attempts.

8. A recloser as claimed in claim 1 wherein said dielectric gas means is pressurized and comprises sulfur hexafluoride chosen to replace oil which exhibited the tendency to produce a fire and explosion hazard.

9. A recloser as claimed in claim 1 wherein said vacuum contact means are multiple in number and are each encased in a separate evacuated vacuum maintaining interrupter casing, moveable means extending externally of said interrupter casings to permit actuation of said contacts by motion of said moveable means, a yoke means connected to said moveable means of each of said casings to permit said contact means collectively to separate in one direction and close in the opposite direction, said yoke connected by a link to said solenoid plunger for movement by activation of said solenoid.

10. A recloser as claimed in claim 9 wherein said vacuum maintained contact interrupters are three in number.

11. A recloser as claimed in claim 1 wherein said solenoid is operable by said high voltage electric circuit.

12. A recloser as claimed in claim 11 wherein said solenoid is adapted to accept high voltages in the range of 14.4 kV to 26 kV at sixty (60) hertz as well as short term impulse voltages in excess of said range.

13. A recloser as claimed in claim 12 wherein said solenoid is also adapted to operate on direct current voltages in the order of 240 VDC.

14. A recloser as claimed in claim 1 wherein said solenoid includes a solenoid frame with spaced ends, a coil form having at least one open end and one closed end supported within said spaced ends of said frame and forming said central chamber, a pot coil encircling said coil form and capable of accepting and being activated by high voltages, i.e. in the range of 14.4 kV to 26 kV at sixty (60) hertz and impulse voltages in excess of said range; as well as low direct current voltage supply i.e. 240 VDC; said solenoid plunger means being telescoped through a central opening in the upper end of said solenoid frame into said co-axial central chamber of said coil form, said central opening in the upper end of said frame being complimentary to said plunger, said dielectric gas filling said central chamber and causing a cushioning and dampening effect on movement of said plunger in a downward, as well as in an upward, direction; said plunger having means for controlling movement of said gas past its sides during movement through said upper solenoid frame means.

15. A recloser as claimed in claim 14 wherein said means for controlling movement of said gas includes said plunger being provided with axially extending radial slot means at opposite ends of said plunger said slot means communicating with said chamber and extending axially for a substantial portion of the length of said plunger, whereby said gas can find egress from said chamber through said slot means when said plunger is partially retracted from said chamber.

16. A recloser as claimed in claim 15 wherein the opposite lower end of said solenoid frame includes a central aperture adapted to accept a plunger stop for limiting the downward movement of said plunger, said plunger stop including a central bore communicating from end to end and aligned with said central aperture, and a spring loaded orifice plate means restricting said central bore and aperture, whereby increased pressure of said gas upon compression by said plunger causes said plate to move against its said spring loading to thereby permit lateral egrees of gas between said plate and the bottom ed of said plunger stop and said solenoid frame.

17. A recloser as claimed in claim 16 wherein said orifice means includes a check valve means communicating with said central bore of said plunger stop.

18. A recloser as claimed in claim 17 wherein said check valve includes ball cock means which when seated during the closing operation and the downward movement of said plunger to close said contacts the gas is compressed within said chamber and its downward movement is fully dampened, however, said check valve orifice is open on opening upward movement of said plunger and permits limited movement of said plunger return.

19. The recloser of claim 1 wherein said sealed chamber assembly includes a modular assembly consisting of a tank and cover assembly with bearing and sealing means, thereby providing rotational support and a gas pressure seal respectively, said modular sealed chamber assembly further including:

a first seal means for sealing said tank to said cover assembly;

a second seal means for sealing said cover assembly to a shaft; and a means for attaching said tank to said cover assembly.

20. The recloser of claim 19 wherein said seal assembly comprises a modular assembly consisting of two housings, including a bearing housing and a seal housing, required for sealing a flanged type rotary seal.

21. A solenoid for use in a sealed pressurized dielectric gaseous atmosphere including in combination a pressurized container accepting a predetermined pressurized dielectric gas, said solenoid having a magnetizable solenoid frame, a coil assembly including a pot coil wound on a hollow bore coil form with leads connected to a high voltage system through a switch connected to said solenoid, said solenoid frame supporting said coil assembly from end at the top of said coil form, a magnetizable solenoid plunger, a central aperture in said solenoid frame guiding said plunger into coaxial movement within said coil form hollow bore, a magnetizable apertured bride plate spaced from said solenoid frame and supporting said coil assembly from the opposite bottom end, said solenoid frame, said coil form and said bridge plate each serving as part of a magnetic circuit, a gas pressure relief means located at the bottom end of said hollow bore, said bridge plate supporting a plunger stop means adapted to stop said plunger during the closing operation when said plunger is magnetically drawn axially within said hollow form bore, said plunger stop means being an assembly consisting of at least a resiliency absorbent non-metallic stop, and a non-magnetic metallic ring spacer between said absorbent stop and said plunger stop means, a plurality of stringer means used to space and clamp said solenoid frame, said pot coil, said coil form and said bridge plate together to withstand the resulting magnetic forces and form a part of said magnetic circuit, said gas pressure relief means utilized to regulate the pressure or vacuum produced in the hollow coil form chamber during the closing and opening operations respectively, said solenoid plunger including axially extending radial slots cut to a depth and length to limit eddy current losses and to adjust the vacuum upon the opening of the solenoid by movement of the plunger outwardly through said coil frame central aperture, said slots also adjusting the pressure buildup after a closing operation, and linkage means connected to said plunger to provide a motive force for operation of secondary means.

22. A solenoid as claimed in claim 21 wherein said dielectric gas is sulfur hexafluoride.

23. A recloser as claimed in claim 4 wherein said second damper means includes said dielectric gas means infiltrating said inverted cup-like means and when compressed by movement of said piston-like means within said cup-like means serves to cushion and dampen the movement of said coaxially disposed contact means within said evacuated chamber and thereby forming said second damper means to reduce bounce and possible arcing during the opening of said contacts.

24. A recloser as claimed in claim 23 said enclosing means forming said sealed chamber for said recloser including a tank assembly and a cover assembly, said cover assembly having substantially rigid frame means extending therefrom and acceptable within said tank assembly to mount and maintain said solenoid means, said associated link means, and said vacuum contact means and its associated actuator means in generally compact spaced parallel operable interelationship.

25. An interrupted electric circuit recloser means for reclosing an interrupted high voltage electric recloser means for reclosing an interrupted high voltage electric circuit including a sealed tank chamber for enclosing said recloser means, a dielectric pressurized gas filling said sealed tank chamber, said recloser having vacuum contact means which will be tripped and separated by the absence/excess or severe reduction in normal high voltage, said vacuum contact means including compact coaxial dampener means for preventing bounce of said contact means during opening of said interrupted high voltage circuit, and high voltage solenoid means including link means interconnected with said vacuum contact means adapted to activate means to a close condition, said solenoid having integral coaxial dampener means for controlling bounce of said contact means during closing of said circuit.

* * * * *